United States Patent [19]

Switten

[11] 4,455,850

[45] Jun. 26, 1984

[54] CAN MANUFACTURE

[75] Inventor: Jan M. B. Switten, St. Katelyne Waver, Belgium

[73] Assignee: E. I. Du Pont de Nemours and Company, Wilmington, Del.

[21] Appl. No.: 414,531

[22] PCT Filed: Dec. 28, 1981

[86] PCT No.: PCT/US81/01749

§ 371 Date: Aug. 30, 1982

§ 102(e) Date: Aug. 30, 1982

[87] PCT Pub. No.: WO82/02349

PCT Pub. Date: Jul. 22, 1982

[30] Foreign Application Priority Data

Dec. 31, 1980 [WO] PCT Int'l. Appl. ..... PCT/US80/01757

[51] Int. Cl.[3] ..... B21D 22/00

[52] U.S. Cl. ..... 72/46; 72/347

[58] Field of Search ..... 72/347, 40, 349, 46, 72/47, 341

[56] References Cited

U.S. PATENT DOCUMENTS 2,116,345 5/1938 Floraday ..... 72/47

3,927,217 8/1976 Misonoo ..... 72/349

*Primary Examiner*—Leon Gilden

[57] ABSTRACT

A can body is formed from a sheet of metal which has a matte coating composition applied to the portion of the sheet which will become the outside surface of a reentrant convex bottom of the can body.

3 Claims, 4 Drawing Figures

CAN MANUFACTURE

BACKGROUND

Two-piece cans for beer and other pressurized beverages generally have a reentrant convex shape for their bottom. This permits the use of thinner metal while resisting distortion of the can by the pressure of the beverage.

Coatings are generally used on the inside of beverage cans to prevent corrosion and to protect the flavor of the beverage. Coatings are also used on the outside of beverage cans to facilitate decoration and identification of the can and its contents. However, if the can is made of adequately corrosion resistant material such as aluminum or tin-plated steel of an appropriate quality, it is generally not necessary to apply any coatings to the outside of the bottom of the can.

Although it probably is unlikely, some think it conceivable that a concave can bottom of uncoated shiney metal, especially bright aluminum, could act as a reflector to concentrate the sun's rays and possibly start a fire in dry grass or underbrush if a used can is discarded by the roadside or in the woods.

Exterior coatings are generally applied to two-piece cans after the can body has been formed. If they were applied before forming, they could be abraided or damaged by the can forming process. And it is difficult to spray a matte coating on the bottom of a formed can without overspraying onto the sides.

SUMMARY OF THE INVENTION

The present invention provides a process for making a cylindrical can body with one end closed from a sheet of metal by a deformation process, said closed end having a reentrant convex shape, wherein first only the area of said sheet which will become the outside surface of said closed end is coated with a flexible coating composition which gives a matte finish, minimizing specular reflectance of light from said area, then the can body is formed from said sheet by a deformation process.

Generally two-piece cans are formed by a drawing and ironing process wherein a ram pushes the center of a flat sheet of metal into a female mold, often involving more than one ram and mold or more than one step. The initial forming steps are known as drawing. The final step or steps in which the precise can shape is formed is known as ironing. The ironing ram and mold typically will be shaped to form a reentrant convex shape at the bottom of the can.

Such a can is called a two-piece can to distinguish it from a three-piece can. A two-piece can includes a cup-shaped can body and one lid or end piece. A three-piece can includes a cylinder open at both ends and two lids.

Preferably, the coating composition is applied to flat sheet metal before any of the deformation is done to form the can body.

DETAILED DESCRIPTION

Suitable coating compositions are known in the art which are quite flexible and which dry to give matte finishes. By minimizing specular reflectance, any potential for discarded cans to accidentally cause fires in dry grass can be minimized. Matte finishes can be obtained by pigmentation, rough surfaces, or combinations thereof, such as by using the compositions disclosed herein.

The flexibility of the coating composition permits applying it to flat sheet and subsequently forming the can body. This avoids the difficulties of applying a paint to the reentrant bottom of a preformed can body. If the reentrant bottom of a preformed can is painted by spraying, it can be desirable to mask the sides of the can to prevent overspray. It is easier to confine the spray to a desired area of a flat sheet.

The reentrant convex bottom of the can body can have a variety of shapes. Generally the shapes will include some portions of smooth curves, although part of the bottom can be flat. The advantages of the invention are available in a wide variety of applications which will be apparent from the above to those skilled in the art of can making and coating.

Figure 1:
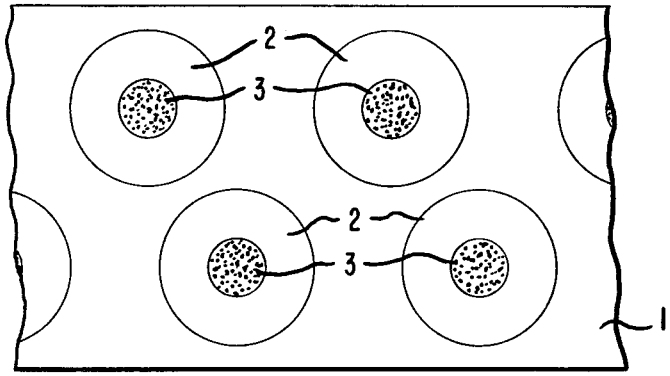
FIG. 1 is a plan view of part of an uncoiled sheet of metal indicating the location of can blanks which are to be coated according to the invention and cut from the sheet.

Turning now to the drawing, FIG. 1 illustrates a portion of an uncoiled sheet 1 of metal, such as thin aluminum or steel, showing the placement of can blanks 2 to be punched from the metal and the location of the matte finish 3 of the invention on the blanks 2. The matte finish 3 can be coated onto the can blanks 2 before or after they are cut from sheet 1 but preferably before.

Figure 2:
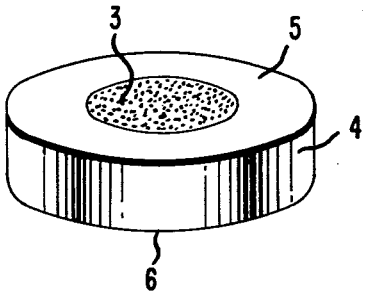
FIG. 2 is a perspective view of a partially formed cup shape drawn from a blank of FIG. 1.
Figure 3:
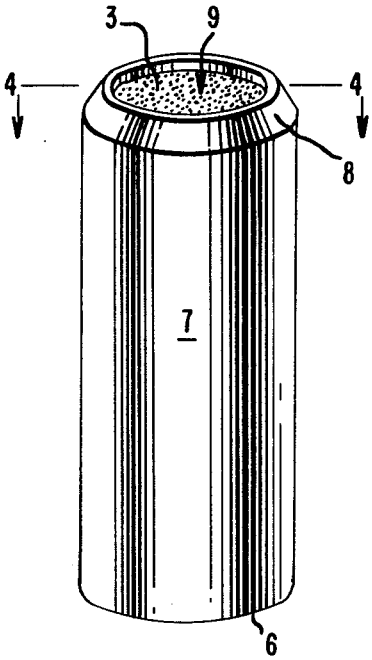
FIG. 3 is a perspective view of a formed can body drawn and ironed from a blank of FIG. 1.

FIG. 2 is a perspective view of a can blank which has been partially formed by drawing a flat blank 2 into a cup shape. FIG. 2 illustrates vertical wall 4 and flat bottom 5 with the matte finish 3 in the middle of flat bottom 5. The partially formed can body is inverted in FIG. 2 with open end 6 shown at the bottom. Normally, open end 6 is considered to be the top of the can. FIG. 3 is a perspective view of a formed can body drawn and ironed from the partially formed blank of FIG. 2. The side wall 7 has been lengthened and flat bottom 5 has been decreased in diameter to produce angular shoulder 8 and reentrant convex shape 9. This convex shape 9 is the part of the can which is coated with matte finish 3.

Figure 4:
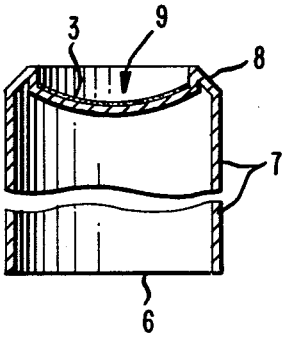
FIG. 4 is a cross-sectional view along the section line 4—4 in FIG. 3.

FIG. 4 is a cross-sectional view taken along cut plane 4—4 of FIG. 3. FIG. 4 more completely illustrates the nature and relationship of convex shape 9 with its matte finish 3 to angular shoulder 8, wall 7 and open end 6.

Of course, the precise contour of a convex shape 9 and the use of angular shoulder 8 are matters of choice. Other contours, shapes and designs can be used in the spirit of the invention.

In the following Example, parts, percentages and proportions are by weight except as indicated otherwise.

EXAMPLE

Acrylic Resin A is prepared, then mixed with the other ingredients as indicated below to make a Can Coating Composition. A Wax Dispersion combined with an Antiblocking Agent is added as a lubricant for can forming, and the gloss level is adjusted as desired by additions of the Gloss Adjusting Clear. The Can Coating Composition is a low gloss blend of an acrylic resin, an epoxy resin and a melamine cross linker.

| | | |
|---|---|---|
| Acrylic Resin A | | |
| Solvesso 100 hydrocarbon solvent-Exxon | | 14.88 |
| Ethylene glycol mono-ethylether acetate | | 9.54 |
| n-butanol | | 5.42 |
| Isopropanol | | 0.96 |
| Add in order - heat to reflux 118° C. | | |
| Methylmethacrylate | | 18.72 |
| Ethylacrylate | | 27.36 |
| Methacrylic acid | | 1.92 |
| Di-tert butyl peroxide | | 0.78 |
| Load in premix tank. | | |
| Add to reactor over 2 hours period. | | |
| Hold at reflux for 3 hours. | | |
| Solvesso 100 | | 10.60 |
| Ethylene glycol mono-butylether | | 10.60 |
| | Total | 100.780 |
| | Loss | 0.780 |
| | Yield | 100.00 |
| MMA/EA/MAA weight ratio | = 39/57/4 | |
| Solids by weight | 48% (90 min. at 150° C.) | |
| Acid number | 25–30 | |
| Viscosity | Z2–Z4 (Gardner Holdt) | |
| Liter weight | 995 g | |
| Anti-blocking Solution | | |
| Acrylic Resin A | | 16.84 |
| Solvesso 100 | | 29.90 |
| Syloid 74 silica pigment - W. R. Grace | | 18.48 |
| Ethylene glycol mono-butylether | | 31.84 |
| Solvesso 100 | | 2.94 |
| Grind in sand mill to fineness of <1 μm particle size. | | 100.00 |
| Adjust solids with 50/50 ethylene glycol mono-butylether and Solvesso 100. | | |
| Solids by weight | 26.563% | |
| Liter weight | 1005 g | |
| Fineness | <1 μm | |
| Wax Dispersion | | |
| Solvesso 150 hydrocarbon solvent-Exxon | | 40 |
| Polyethylene wax AC 405-Allied Chemical | | 10 |
| Heat to 100° C. and mix about 30 min. | | |
| Solvesso 150 | | 50 |
| Add as fast as possible with rapid agitation and mix until temperature is below 30° C. | | 100 |
| solids by weight | 10% | |
| Liter weight | 884 g | |
| Gloss Adjustment Clear | | |
| Acrylic Resin A | | 84.96 |
| Epikote 828 epoxy resin-Shell Chemical | | 3.73 |
| Cymel 303 highly methylated melamine | | 2.54 |
| Ethylene glycol mono-butylether | | 2.00 |

-continued

| | | |
|---|---|---|
| Solvesso 100 | | 2.00 |
| Wax Dispersion | | 1.85 |
| Mix 1 hour. | | |
| Ethylene glycol mono-butylether | | 1.46 |
| Soya bean oil | | 1.46 |
| | | 100.00 |
| Solids by weight | 48.7% | |
| Density | 0.9943 | |
| Can Coating Composition | | |
| Acrylic Resin A | | 65.85 |
| Epikote 828 | | 2.89 |
| Cymel 303 | | 1.97 |
| Ethylene glycol mono-butylether | | 4.00 |
| Solvesso 100 | | 4.00 |
| Add in order with mixing. | | |
| Antiblocking Solution | | 15.600 |
| Wax dispersion | | 1.40 |
| Mix 1 hour - sample to lab for gloss adjustment. | | |
| Anti-blocking solution | | trace |
| Gloss Adjustment Clear | | trace |
| Solvesso 100 | | 2.130 |
| Ethylene glycol mono-butylether | | 2.130 |
| | | 100.00 |
| Solids by weight | 40.7% | |
| Gardner Color | 2 max | |
| Gardner Gloss | 80 min at 85° angle | |
| Viscosity | DIN 4 85–95 | |
| Liter weight | 985.9 g | |
| Solids by volume | 33.400% | |
| Solids Proportions | | |
| Resins | | |
| Cymel 303 | 1.970 | 5.22 |
| Epikote 828 | 2.890 | 7.66 |
| Acrylic Resin A | 32.868 | 87.12 |
| | | 100.00 |
| Pigment | | |
| Flatting agent | Syloid 74 | 2.88 |

I claim:

1. A process for making a cylindrical can body with one end closed from a sheet of metal by a deformation process, said closed end having a reentrant convex shape, wherein first only the area of said sheet which will become the outside surface of said closed end is coated with a flexible coating composition which gives a matte finish, minimizing specular reflectance of light from said area, then the can body is formed from said sheet by a deformation process.

2. The process of claim 1 wherein the deformation process is a drawing and ironing process.

3. The process of claim 1 wherein said sheet is flat when it is coated, and then the can is formed by a drawing and ironing process which also forms the reentrant convex shape.

* * * * *